US009138039B2

(12) United States Patent
DeBenedictis et al.

(10) Patent No.: US 9,138,039 B2
(45) Date of Patent: Sep. 22, 2015

(54) HAIR STYLING DEVICE

(75) Inventors: Alfredo DeBenedictis, Crumlin Northern Ireland (GB); Janusz Lucien Holland, Birmingham (GB)

(73) Assignee: SF3 LIMITED, Birmingham (GB)

( * ) Notice: Subject to any disclaimer, the term of this patent is extended or adjusted under 35 U.S.C. 154(b) by 0 days.

(21) Appl. No.: 14/116,124

(22) PCT Filed: May 8, 2012

(86) PCT No.: PCT/GB2012/050999

§ 371 (c)(1),
(2), (4) Date: Nov. 25, 2013

(87) PCT Pub. No.: WO2012/153118

PCT Pub. Date: Nov. 15, 2012

(65) Prior Publication Data

US 2014/0076351 A1 Mar. 20, 2014

(30) Foreign Application Priority Data

May 9, 2011 (GB) ..... 1107671.8

(51) Int. Cl.
*A45D 2/00* (2006.01)
*A45D 7/02* (2006.01)
(Continued)

(52) U.S. Cl.
CPC *A45D 2/146* (2013.01); *A45D 2/00* (2013.01); *A45D 2/18* (2013.01); *A45D 2002/025* (2013.01)

(58) Field of Classification Search
CPC ..... A45D 2/02; A45D 2/08; A45D 2/12; A45D 2/122; A45D 2/125; A45D 2/127; A45D 2/14; A45D 2/146; A45D 2/2464; A45D 2/18; A45D 2/00; A45D 2/2457; A45D 2/38; A45D 2/20; A45D 2/22; A45D 2/2407; A45D 2002/025; A45D 2002/03; A45D 2002/008; A45D 7/00; A45D 7/045; A45D 2007/002; A45D 8/00; A45D 8/34; A45D 6/00; A45D 6/06; A45D 19/0025; A45D 19/0008
USPC ..... 132/268, 200, 212, 210, 333, 222–226, 132/240, 241, 245–257, 265, 266, 270, 273, 132/274
See application file for complete search history.

(56) References Cited

U.S. PATENT DOCUMENTS 1,636,967 A * 7/1927 Perry ..... 132/211
1,827,785 A * 10/1931 Frederics ..... 132/211
(Continued)

FOREIGN PATENT DOCUMENTS

EP 1417906 A1 5/2004
GB 1036583 A 7/1966
(Continued)

*Primary Examiner* — Vanitha Elgart
(74) *Attorney, Agent, or Firm* — Hultquist, PLLC; Steven J. Hultquist

(57) ABSTRACT

This invention relates to an improved hair styling device, and provides a hair styling device for imparting a wave to a tress of hair. The device comprises a tube (110) having a longitudinal axis, the tube being open at at least one of its longitudinal ends whereby the tress of hair can be introduced into the tube. The tube is longitudinally extendable between a non-extended condition and an extended condition. The inside of the tube has at least one barrier (120) which can engage the tress of hair as the tube moves towards its non-extended condition, the barrier controlling the deformation of the tress of hair and thereby controlling the form of the wave produced in the tress of hair.

16 Claims, 5 Drawing Sheets

(51) Int. Cl.

| | |
|---|---|
| ***A45D 2/14*** | (2006.01) |
| ***A45D 2/18*** | (2006.01) |
| *A45D 2/02* | (2006.01) |

(56) References Cited

U.S. PATENT DOCUMENTS

| | | | | | |
|---|---|---|---|---|---|
| 1,831,487 | A | * | 11/1931 | Elam | 132/251 |
| 1,884,305 | A | * | 10/1932 | Shelton | 132/206 |
| 1,895,653 | A | * | 1/1933 | Fisher | 132/268 |
| 1,981,362 | A | * | 11/1934 | Joyce | 132/222 |
| 2,791,225 | A | * | 5/1957 | Simmons | 132/210 |
| 3,213,859 | A | * | 10/1965 | Mizell et al. | 132/210 |
| 3,255,765 | A | * | 6/1966 | Sturdivant | 132/223 |
| 3,786,819 | A | * | 1/1974 | Cantrell | 132/270 |
| 3,805,810 | A | | 4/1974 | Savala | |
| 3,968,805 | A | * | 7/1976 | Sobeck, Jr. | 132/270 |
| 4,148,330 | A | | 4/1979 | Gnaga | |
| 5,472,003 | A | * | 12/1995 | Frame et al. | 132/275 |
| 5,584,309 | A | * | 12/1996 | De Beneditis et al. | 132/208 |
| 5,771,906 | A | * | 6/1998 | De Benedictis | 132/207 |
| 5,813,419 | A | * | 9/1998 | Brams | 132/222 |
| 6,647,989 | B1 | * | 11/2003 | De Benedictis | 132/210 |
| 7,121,285 | B2 | * | 10/2006 | Kraus | 132/250 |
| 7,198,049 | B2 | * | 4/2007 | Elmer et al. | 132/208 |
| 7,305,995 | B2 | * | 12/2007 | Tojo et al. | 132/222 |
| 7,487,783 | B2 | * | 2/2009 | Saito | 132/212 |
| 7,500,487 | B2 | * | 3/2009 | Kobayashi et al. | 132/222 |
| 7,770,586 | B2 | * | 8/2010 | Tojo et al. | 132/222 |
| 7,789,093 | B2 | * | 9/2010 | Tojo et al. | 132/207 |
| 8,132,575 | B2 | * | 3/2012 | Tojo et al. | 132/270 |
| 8,256,438 | B2 | * | 9/2012 | Tojo et al. | 132/270 |
| 2004/0231689 | A1 | * | 11/2004 | Kobayashi et al. | 132/222 |
| 2004/0231690 | A1 | * | 11/2004 | De Benedictis | 132/270 |
| 2005/0284493 | A1 | * | 12/2005 | Allen | 132/225 |
| 2006/0124148 | A1 | * | 6/2006 | Tojo et al. | 132/210 |
| 2006/0157078 | A1 | * | 7/2006 | Tojo et al. | 132/222 |
| 2007/0017541 | A1 | * | 1/2007 | Wilmore | 132/258 |
| 2007/0065489 | A1 | * | 3/2007 | Tojo et al. | 424/443 |
| 2007/0068547 | A1 | * | 3/2007 | Gurth et al. | 132/200 |
| 2007/0084479 | A1 | * | 4/2007 | Ryan-Jakimas | 132/246 |
| 2008/0302381 | A1 | * | 12/2008 | Tojo et al. | 132/222 |
| 2009/0056738 | A1 | * | 3/2009 | Tojo et al. | 132/270 |
| 2010/0083978 | A1 | | 4/2010 | Hottenrott et al. | |
| 2012/0186601 | A1 | * | 7/2012 | Ungar et al. | 132/273 |

FOREIGN PATENT DOCUMENTS

| | | | |
|---|---|---|---|
| GB | 302952 | A | 12/1978 |
| JP | 2005324073 | A | 11/2005 |
| WO | 0008967 | A1 | 2/2000 |

* cited by examiner

HAIR STYLING DEVICE

CROSS-REFERENCE TO RELATED APPLICATIONS

This application is a U.S. national phase under the provisions of 35 U.S.C. §371 of International Patent Application No. PCT/GB12/50999 filed May. 8, 2012, which in turn claims the priority of Great Britain Patent Application No. 1107671.8filed May. 9, 2011. The disclosures of such international patent application and Great Britain priority patent application are hereby incorporated herein by reference in their respective entireties, for all purposes.

FIELD OF THE INVENTION

This invention relates to an improved hair styling device.

BACKGROUND TO THE INVENTION

A hair styling device is described in WO95/22920, by the present inventor. WO95/22920 discloses a method of styling a tress of hair by inserting the tress of hair into a resilient tube of latex or the like, the tube being stretched lengthwise and the ends of the tube being secured to respective parts of the tress of hair. The resilient tube is allowed to contract whereupon the contained tress of hair is forced into a wavy form. The hair can be treated before or after insertion into the tube so that the wavy form is maintained after the tress has been removed from the tube.

WO95/22920 also describes a device for use in the method. Improved devices for use in similar hair styling methods are described in the inventor's later applications WO97/46132, WO00/57744 and WO00/08967.

All of these prior art documents are incorporated herein by reference so as to avoid unnecessary repetition of the method of hair styling and the basic structure of devices for use in the method, which method and basic structure are shared by the present invention.

SUMMARY OF THE INVENTION

The inventor has conceived a further improvement to the devices which are used in the method of hair styling, and the present invention is directed to the further improved device.

According to the present invention there is provided a hair styling device for imparting a wave to a tress of hair, the device comprising a tube having a longitudinal axis, the tube being open at at least one of its longitudinal ends whereby the tress of hair can be introduced into the tube, the tube being longitudinally extendable between a non-extended condition and an extended condition, characterised in that the inside of the tube has at least one barrier which can engage the tress of hair as the tube moves towards its non-extended condition.

With the present invention therefore, the deformation of the tress of hair is controlled (at least partially) by the engagement between the barrier(s) and the tress of hair, the form of the wave produced in the tress being controlled by the barrier (s).

With the previously-described devices the wave which was produced in the tress of hair was largely uncontrolled, so that the wavelength and amplitude of the wave could vary along the length of a tress, and from one tress to another for a particular user. The inventor has appreciated the benefits of better controlling the form of the wave within the tube, and therefore the form of the wave when removed from the tube, and the resulting ability to produce a more uniform wave in each tress, and more uniform waves in all of the tresses of a user's hair.

Preferably, the tube is open at both ends allowing the tress of hair to be passed therethrough. Preferably also the tube is formed of resilient material.

Desirably, the device includes means to grip the tress of hair. The means to grip the tress of hair will help to retain the tress of hair within the device as the tube moves from its extended condition to its non-extended condition.

Preferably, there is a plurality of barriers at predetermined positions along the length of the tube.

Ideally, there are two lines of barriers, the lines of barriers being spaced apart to permit the tress of hair to be passed along the tube between the lines of barriers. Ideally also the barriers in one line are offset from the barriers in the other line, so that the respective barriers provide a stepped or staggered arrangement, the tress of hair being able to deform into the spaces between the staggered barriers, the positioning of the barriers thereby determining the form of the wave in the tress of hair.

Preferably, the barriers completely span the tube, whereby it is not possible for any of the tress of hair to pass over or around the end of a barrier. It will be understood that if any of the tress of hair passes over or around the end of a barrier the styling of the tress will be less uniform than desired, and also it may be more difficult to remove the tress of hair from the tube at the end of the styling process.

Desirably, the tube is not circular, but is of "flattened" cross-section, for example having two substantially planar sides joined by short, rounded, edges. The barriers preferably span the distance between the substantially planar sides, and can be connected to both of the sides whereby to help maintained the flattened form of the tube.

Preferably, the device includes a housing for the tube. The devices of WO97/46132, WO00/08967 and WO00/57744 include housings for their respective tubes, and the present invention preferably includes a (similar) housing. As described in the earlier documents, the housing facilitates easier manipulation of the tube in use, and also reduces the contact necessary with the tube, which is particularly preferable when the tube is heated.

In embodiments including housings, the housings can carry the means to grip the tress of hair, suitably in the form of a clip or the like which can clamp a part of the tress of hair.

Desirably, the tube is made of silicone. Silicone is a very suitable material because it has the desired resilience and is also able to withstand temperatures up to around 250° C., i.e. in excess of those required to set hair. When using a silicone tube it is possible to set the wave by using heat instead of (or as well as) using chemical treatments. In some embodiments the tube material can be coated or impregnated with metallic particles such as glitter; not only does this increase the visual appeal of the tube it enhances its thermal characteristics, for example allowing the tube to retain a greater amount of heat. The coating or impregnating material can be chosen to make the tube more susceptible to induction heating if that form of heating is utilised.

Alternatively, the tube can contain a single barrier shaped to form the desired wave in the tress of hair. In one embodiment the barrier can be in the form of a helix mounted to the inside of the tube. In such embodiments the tube can be of substantially circular cross-section, the helical barrier spanning only part of the diameter of the tube so that the tube has a central open channel along which the tress of hair can be passed.

BRIEF DESCRIPTION OF THE PREFERRED EMBODIMENTS

The invention will now be described in more detail, by way of example, with reference to the accompanying drawings, in which.

DETAILED DESCRIPTION

FIGS. 1-9 of the accompanying drawings show various embodiments of tube of the improved hair styling device. It will be understood from the following description that the tube can be used alone, i.e. with the user or stylist gripping and manipulating the tube and the tress of hair as required. In such cases the tube can comprise the whole of the hair styling device.

It will also be understood that the device can incorporate a housing for the tube, such as one of the housings shown in FIGS. 10-15. The provision of a housing can make the manipulation of the device easier for the user, and can also make use of the device more comfortable, particularly if the tube is heated. In such embodiments the hair styling device will comprise the tube and housing.

Figure 1:
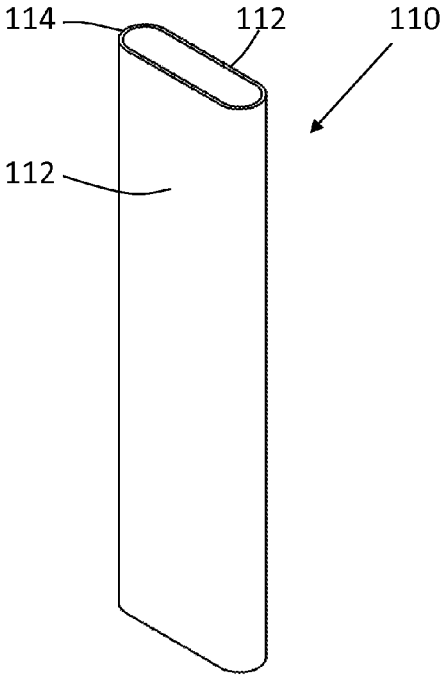
FIG. 1 shows a perspective view of a first embodiment of tube for a device according to the present invention.
Figure 2:
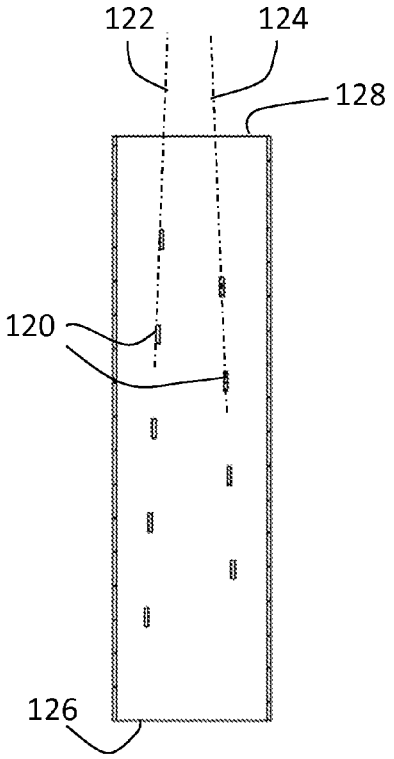
FIG. 2 shows a side sectional view of the tube of FIG. 1.
Figure 3:
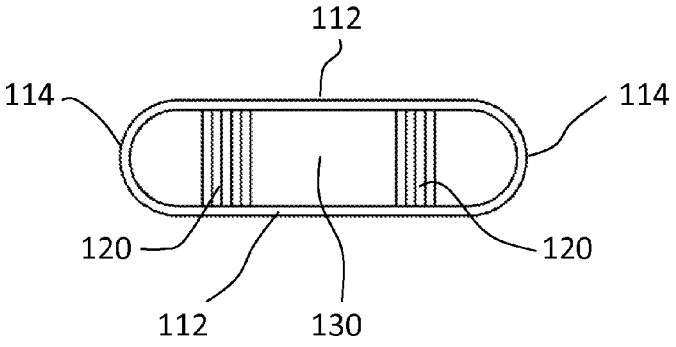
FIG. 3 shows an end view of the tube of FIG. 1.

The first embodiment comprises tube 110 as shown in FIGS. 1-3. The tube is of flattened form, having two substantially planar sides 112 connected by rounded edges 114. The planar sides 112 are also interconnected by barriers 120 (the barriers are not visible in FIG. 1), the respective ends of each barrier 120 being secured (suitably by welding or adhesive) to the inside of each of the sides 112 whereby the barriers 120 span the interior of the tube as shown in FIG. 3.

As better seen in FIG. 2, the barriers are arranged in two substantially straight lines 122, 124. The lines 122, 124 in this embodiment are not parallel, but converge towards one end of the tube (which end will typically hold the "free" end of the tress of hair, as opposed to the "scalp" end).

It will be understood that the convergence of the lines 122, 124 is not essential to the invention (and is not shared by all of the embodiments shown), and neither is it essential that the lines be substantially straight. However, since it is a feature of the present invention that the form of the wave produced in the tress of hair is more uniform than that available with the prior devices of this type, it is desired that the arrangement of the barriers 120 be in a regular rather than a random pattern.

As also better seen in FIG. 2, the barriers 120 in the line 122 are offset or staggered relative to the barriers 120 in the line 124.

In use, a tress of hair (not shown) is passed along the tube 110, from the first end 126 of the tube 110 to the second end 128 (the first end 126 being located adjacent to the user's scalp). The first end 126 is necessarily open to receive the tress of hair, and the second end 128 is ideally also open so that a suitable hooked tool can be passed through the tube 110 from the second end 128 to the first end 126 in order to capture the tress of hair and pull it through the tube (see the hooked tool 40 of FIG. 15 for example). It will be understood that it is not necessary for the tress of hair to pass through the second end 128, and the tress of hair may be shorter than the tube 10 for example.

The tress of hair is passed along the central area 130 of the tube 110, and specifically between the lines 122 and 124. The first end 126 of the tube 110 is held or temporarily secured to the scalp end of the tress of hair. When the tube 110 is subsequently extended (stretched) longitudinally, the central area 130 becomes compressed laterally, and in certain cases may compress the tress of hair within the central area. The free end of the tress of hair is then held or temporarily secured adjacent to the second end 128 of the tube 110, ensuring that the tress of hair which is within the extended tube 110 will remain within the tube 10 as the tube is gradually released to move back towards its non-extended state.

As described in W095/22920, as the tube 110 contracts back towards its non-extended state, the tress of hair is caused to deform into a wavy form within the tube 110. During this deformation, parts of the tress of hair engage the barriers 120, and the relative locations of the barriers, and in particular their staggered arrangement, controls the tress of hair to deform into a wave having a predetermined wavelength and amplitude. In the preferred embodiments the arrangement of the barriers 120 is uniform along the length of the tube 110, so that the resulting wavy form is similarly uniform.

The wall of the tube 110 of FIGS. 1-3 is formed from silicone having a thickness (in the relaxed state) of 1 mm. The barriers 120 are formed of the same material and are therefore substantially planar. The ends of the barriers 120 are welded to the sides 112 of the tube 110.

Figure 4:
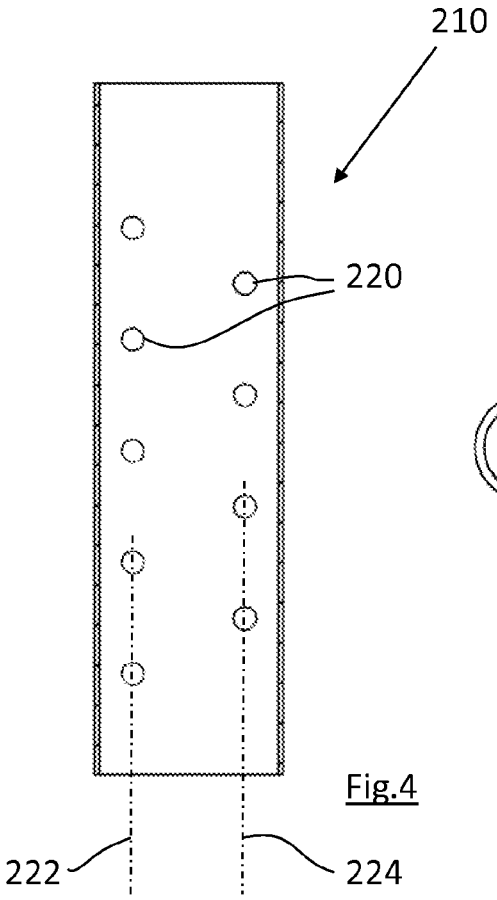
FIG. 4 shows a side sectional view of a second embodiment of tube.
Figure 5:
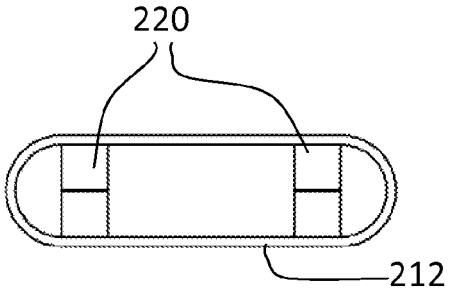
FIG. 5 shows an end view of the tube of FIG. 4.

In the second embodiment of FIGS. 4 and 5, the barriers 220 of the tube 210 are substantially circular in cross-section, having a diameter of approximately 5 mm. It will be seen from FIG. 4 that the two lines 222 and 224 are substantially parallel in this embodiment, but they could alternatively converge if desired as in the first embodiment, or diverge.

It will be seen from FIG. 5 that the barriers 220 are formed in two halves (with each half preferably being integral with its respective side 212. During manufacture of the tube 210 the sides 212 are pressed together to form the flattened shape of the tube 210, and the engaging ends of the barrier halves are secured together by welding or adhesive.

Figure 6:
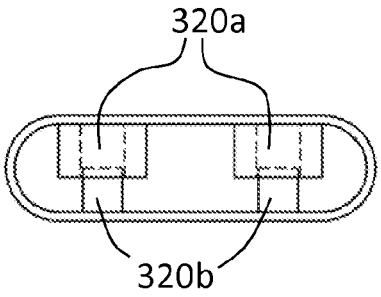
FIG. 6 shows an end view of a third embodiment of tube.

In the third embodiment of FIG. 6 the barriers 320 are of non-uniform cross-section, there being a step between the substantially circular end of the barrier part 320*a* and the substantially circular end of the barrier part 320*b*.

Figure 7:
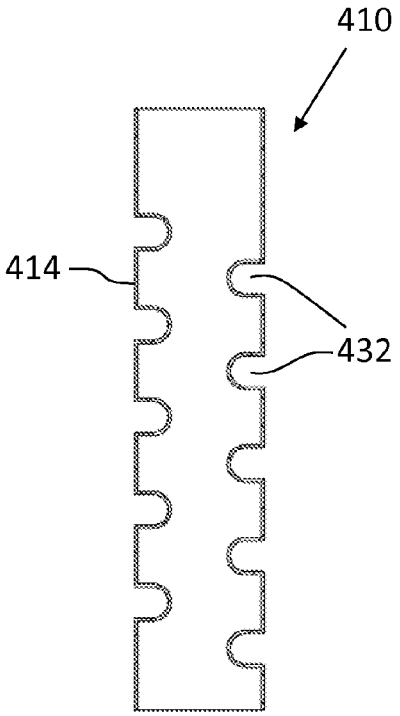
FIG. 7 shows a side sectional view of a fourth embodiment of tube.

In the fourth embodiment of FIG. 7 the barriers are formed by indenting or scalloping of the tube 410, i.e. the edges 414 of the tube are not linear as in the earlier embodiments, but include indentations 432 which define the barriers 420 and thereby define the form of the wave which is produced in the tress of hair.

Figure 8:
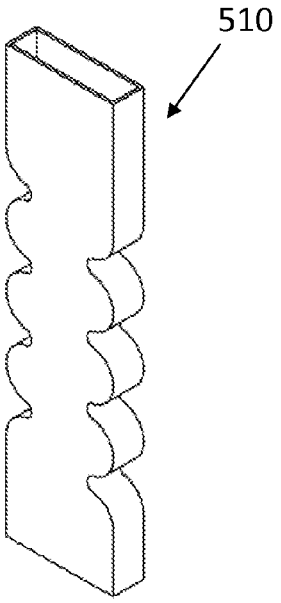
FIG. 8 shows a perspective view of a fifth embodiment of tube.
Figure 9:
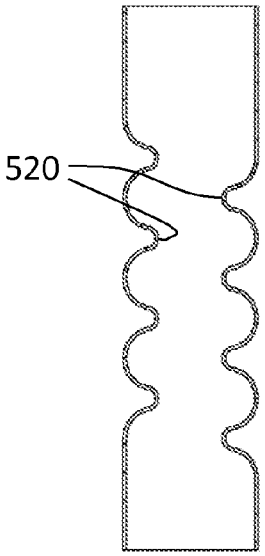
FIG. 9 shows a side sectional view of the tube of FIG. 8.

The fifth embodiment of tube 510 shown in FIGS. 8 and 9 also includes barriers 520 which are formed by scalloping the edges of the tube 510, the scalloped form being intended to more closely match the shape of the wave which is produced.

It will be understood that tubes similar to those of FIGS. 1-9 can be produced by welding or otherwise adhering together parts of the opposing sides of the tube. Thus, an embodiment similar to that of FIGS. 1-3 could be produced by pressing the otherwise substantially planar sides (112) together and welding the sides together at the desired locations for the barriers (120). Similarly, the indentations of the embodiment of FIG. 7 for example could be produced by pressing the sides together adjacent the edges and welding or otherwise adhering the sides together to form barriers similar in form and position to the indentations (432).

Figure 10:
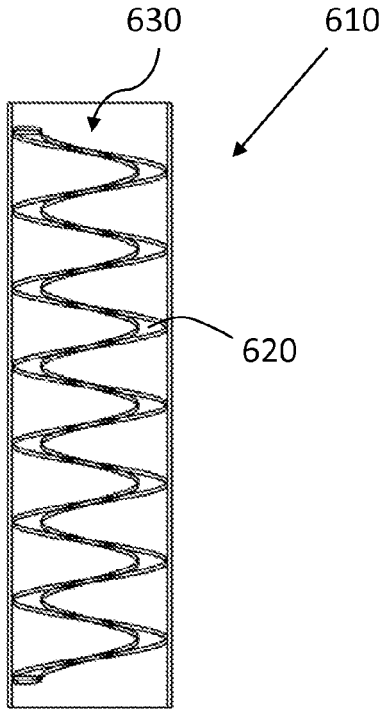
FIG. 10 shows a side sectional view of a sixth embodiment.

The sixth embodiment of tube 610 shown in FIG. 10 differs from the other described embodiments, firstly in utilising a tube of substantially circular cross-section, secondly in utilising a single extended barrier 620, and thirdly in that the barrier does not span the tube. In this embodiment the barrier 620 is helical, comprising a helical web secured to the inside of the tube 610. The barrier 620 occupies only part of the diameter of the tube 610, and leaves a central opening 630 through which the tress of hair may be passed. This embodiment functions in the same way as the other embodiments, however, in that as the tube is relaxed from its extended state, the contained tress of hair is caused to form a wave determined by the location of the helical barrier 620, the tress of hair tending to form a helix of similar pitch to the barrier 620.

Figure 11:
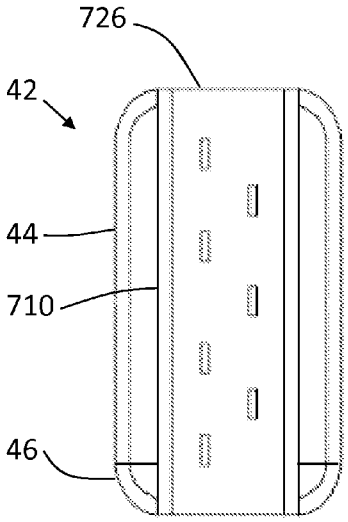
FIG. 11 shows a holder and tube of a seventh embodiment of device according to the present invention, with the tube in its non-extended condition.
Figure 12:
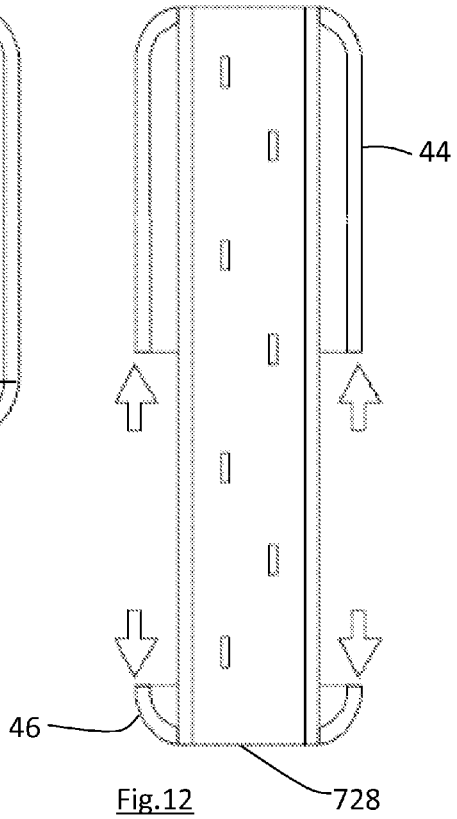
FIG. 12 shows the holder and tube of FIG. 11 with the tube in its extended condition.

FIGS. 11-12 show a seventh embodiment of the device, which comprises a tube 710 and a housing 42. The housing 42 comprises a base part 44 and a top part 46 which can be secured together in the condition of FIG. 11, or can be unsecured and subsequently separated as shown in FIG. 12. The end 726 of the tube 710 is secured to the base part 44, and the end 728 of the tube 710 is secured to the top part 46, respectively. Accordingly, as the user separates the top part 46 from the base part 44 the tube 710 is extended, as shown in FIG. 12. In FIGS. 11 and 12 the tube is similar to the tube 110, but it will be understood that a suitable housing could be used with any of the earlier embodiments.

The housing 42 can have solid walls, or aperture walls, as desired, the latter being beneficial if it is desired to apply heat to the tube (from an external hair dryer for example) in order to dry the tress of hair.

Figure 13:
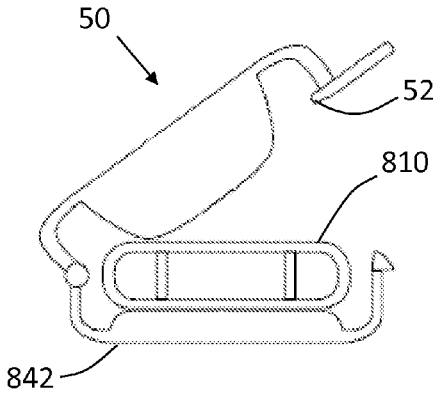
FIG. 13 shows an end view of a holder and tube of an eighth embodiment, with a clip for securing the tress of hair, the clip being in its open condition.
Figure 14:
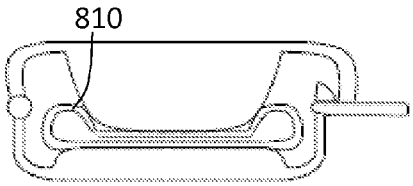
FIG. 14 shows a view similar to FIG. 14 with the clip in its closed condition.

FIGS. 13 and 14 show an optional clip 50 which is provided to grip the tress of hair. The clip 50 is preferably carried by the housing 842 (which may otherwise be identical to the housing 42 of FIGS. 11 and 12). As shown in FIG. 14, when the clip is closed it compresses the tube 810 and thereby compresses and grips the tress of hair within the tube. The clip can be latched in the closed position by the latch member 52.

In an alternative embodiment the clip engages the tress of hair directly, i.e. it does not grip the hair by way of the intervening tube.

It will be understood that the device comprising just the tube 110 (for example), or the device comprising the tube and housing 710, 42, may be used without any means to grip the hair. Such embodiments will require the user or stylist to hold the device against the user's head, and will also require the user or stylist to ensure that the tress of hair remains within the tube as the tube is moved from its extended condition to its non-extended condition. It is, however, preferred that a clip 50 or similar means to grip the hair is provided at the "scalp end" of the device (i.e. adjacent to the end 126 of the tube 110 or the end 726 of the tube 710) so that the device can be left in place whilst the user's hair is drying or is treated so as to maintain the formed wave. In addition, it is preferred that a second clip 50 or similar is provided at the "free end" of the device (i.e. adjacent to the end 128 of the tube 110 or the end 728 of the tube 710), so as to retain the tress of hair within the tube.

Figure 15:
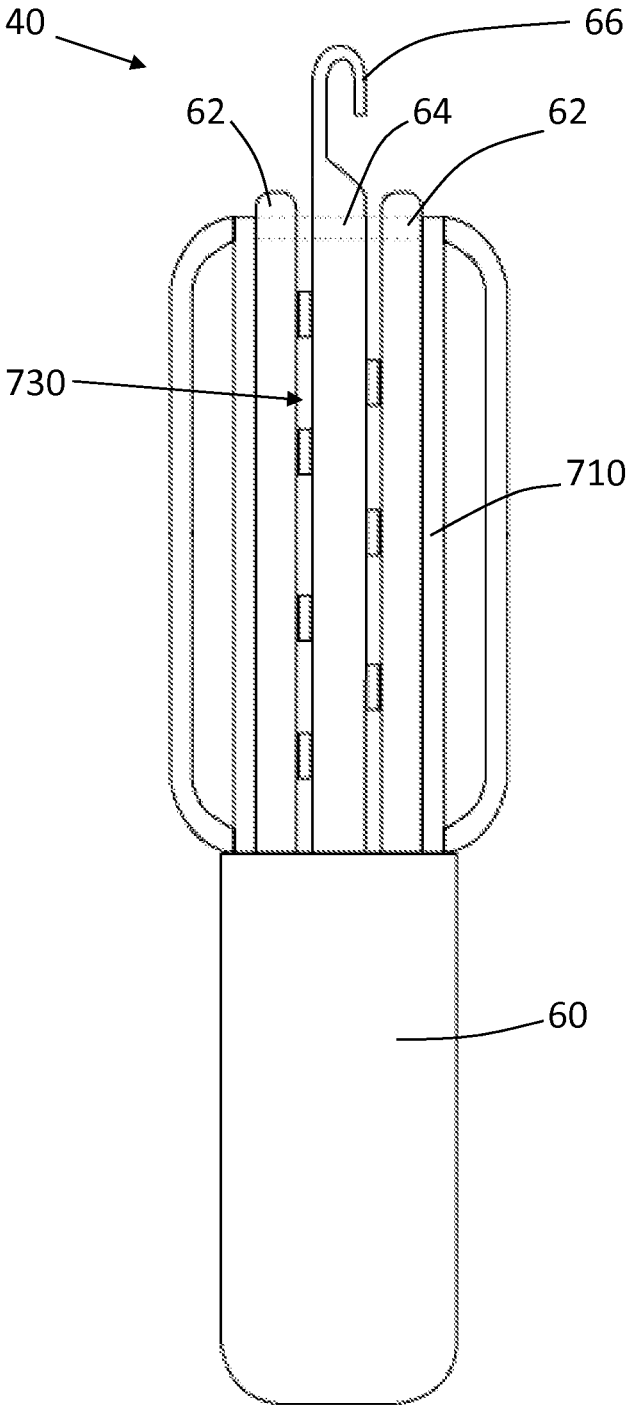
FIG. 15 shows a side sectional view of a combined heating and hooking tool for use with certain embodiments of the device.

FIG. 15 shows a combination heating and hooking tool 40 designed for use with the device of FIGS. 11 and 12. The tool 40 comprises a handle 60 from which projects three forks 62 and 64. One or more of the forks 62 and 64 can be heated whereby to heat the tube 710 prior to the styling operation. The heat may be applied by way of an electrical coil within the fork(s), and actuated by a switch on the handle 60, or by way of external means (such as a hair dryer, or conductive or inductive heater).

The central fork 62 is designed to pass along the central passageway 730 of the tube 710, and is extended to form a hook 66 which can be used to capture the tress of hair (not shown) and (when the tube 710 has reached the desired temperature) pull the tress of hair through the tube 710.

When the tress of hair has been passed through the tube 710, the base part 44 is then held (or secured by a clip such as 50) to the tress of hair adjacent to the user's scalp, and the top part 46 is moved away from the base part 44 so as to extend the tube 710. When the tube 710 has been fully extended, or the top part 46 has been moved to a chosen position relative to the base part 44, the free end of the tress of hair is held (or secured by a clip such as 50) adjacent to the end 728 of the tube 710 so as to retain the tress of hair within the tube. The tube 710 can thereafter be moved to its non-extended position, causing the tress of hair to form a wave within the tube as previously described.

It will be understood that in embodiments of the device which include a housing such as 42, it is not necessary that the barrier(s) be connected to both sides of the tube. Thus, whilst it is desired in most embodiments that the barriers completely span the distance between the sides of the tube, so that no hair may pass around or over the end of a barrier, the housing can also act to press the sides of the tube together and thereby press the sides against the ends of the barriers. Even if a barrier is only connected to one of the sides, the pressure applied by the housing can be sufficient to prevent the unwanted passage of hair around the end of a barrier.

It will also be understood that the form of the tube and housing, and the form and position of the barrier(s) can be varied from those shown in the drawings without departing from the invention. For example, a single line of barriers, or three or more lines of barriers, can be provided. Also, the tube does not require the flattened sides, and could alternatively be of oval or perhaps substantially circular cross-section.

Also, whilst it is preferred that the tube be made of resilient material and that it moves from its non-extended condition to its extended condition by stretching, the invention could be preformed by other means, for example the tube could extend by way of a telescoping action, or in concertina fashion, if desired.

The invention claimed is:

1. A hair styling device for imparting a wave to a tress of hair, the device comprising a tube having a longitudinal axis, the tube being longitudinally extendable between a non-extended condition and an extended condition, the hair styling device being adapted to impart the wave to the tress of hair as the tube moves from its extended condition to its non-extended condition, the tube being open at at least one of its longitudinal ends in its non-extended condition whereby the tress of hair can be introduced into the tube, the tube in its non-extended condition having an open channel along which the tress of hair can be passed, the device including a housing for the tube, the housing having a first part and a second part, the first part being separable from the second part, the housing carrying at least one gripper for gripping the tress of hair, the tube having a wall, the device having at least one barrier which inside the tube is permanently joined to and additional to the wall and which is adapted to engage the tress of hair as the tube moves towards its non-extended condition.

2. The device of claim 1 in which the tube is made of a resilient material, and is open at both of its longitudinal ends.

3. The device of claim 1 in which there is a plurality of barriers at predetermined positions inside the tube.

4. The device of claim 3 in which there are two lines of barriers.

5. The device of claim 4 in which the two lines of barriers are spaced apart and define the open channel between the lines of barriers.

6. The device of claim 4 in which the barriers in one line are offset from the barriers in the other line.

7. The device of claim 1 in which the barriers completely span the tube.

8. The device of claim 1 in which the tube has a non-circular cross section.

9. The device of claim 8 in which the tube has a substantially oblong cross-section comprising two substantially planar sides and two edges.

10. The device of claim 9 in which the barriers are permanently joined to both of the two substantially planar sides.

11. The device of claim 1 in which the barrier is of helical form.

12. The device of claim 1 in which the open channel is linear.

13. The device of claim 2 in which there is a plurality of barriers at predetermined positions inside the tube.

14. The device of claim 2 in which the barrier is of helical form.

15. The device of claim 5 in which the barriers in one line are offset from the barriers in the other line.

16. The device of claim 1 in which the barrier is permanently joined to the wall by one of a welded joint and an adhered joint.

* * * * *

UNITED STATES PATENT AND TRADEMARK OFFICE

CERTIFICATE OF CORRECTION

PATENT NO. : 9,138,039 B2
APPLICATION NO. : 14/116124
DATED : September 22, 2015
INVENTOR(S) : Alfredo DeBenedictis It is certified that error appears in the above-identified patent and that said Letters Patent is hereby corrected as shown below:

In the Specification

Column 1, line 10: "1107671.8filed" should be -- 1107671.8 filed --.

Signed and Sealed this
First Day of December, 2015

Michelle K. Lee

Michelle K. Lee
*Director of the United States Patent and Trademark Office*